US006678900B2

(12) United States Patent
Ware

(10) Patent No.: US 6,678,900 B2
(45) **Date of Patent: *Jan. 20, 2004**

(54) BOWL VENTILATION APPARATUS WITH PROXIMITY SENSOR

(76) Inventor: Derrick Ware, 2006 Cascade Rd., Atlanta, GA (US) 30311

( * ) Notice: Subject to any disclaimer, the term of this patent is extended or adjusted under 35 U.S.C. 154(b) by 0 days.

This patent is subject to a terminal disclaimer.

(21) Appl. No.: 10/420,620

(22) Filed: Apr. 22, 2003

(65) Prior Publication Data

US 2003/0192112 A1 Oct. 16, 2003

Related U.S. Application Data

(63) Continuation-in-part of application No. 10/093,577, filed on Mar. 8, 2002, now Pat. No. 6,550,072.

(51) Int. Cl.[7] ..... E03D 9/04
(52) U.S. Cl. ..... 4/213; 4/209 FF; 4/347
(58) Field of Search ..... 4/289 R, 209 FF, 4/213, 216, 306, 347

(56) References Cited

U.S. PATENT DOCUMENTS

| | | | | | |
|---|---|---|---|---|---|
| 3,066,317 | A | | 12/1962 | Cawiezel | |
| 3,120,665 | A | | 2/1964 | Kirkland | |
| 3,287,743 | A | | 11/1966 | Coates | |
| 3,295,147 | A | | 1/1967 | Meyer | |
| 3,335,431 | A | | 8/1967 | Coates | |
| 3,571,824 | A | | 3/1971 | Poister | |
| 3,585,651 | A | | 6/1971 | Cox | |
| 3,849,808 | A | * | 11/1974 | Olson et al. | 4/213 |
| 3,857,119 | A | | 12/1974 | Humnicutt, Jr. | |
| 4,876,748 | A | | 10/1989 | Chun | |
| 5,210,884 | A | * | 5/1993 | Redford | 4/213 |
| 5,369,812 | A | | 12/1994 | Trombley | |
| 6,260,214 | B1 | | 7/2001 | Smith | |
| 6,550,072 | B1 | * | 4/2003 | Ware | 4/213 |

* cited by examiner

*Primary Examiner*—Michael Mar
*Assistant Examiner*—Tuan N. Nguyen
(74) *Attorney, Agent, or Firm*—Technoprop Colton LLC

(57) ABSTRACT

A toilet bowl ventilation apparatus for treating air from a toilet having an intake duct proximal to the toilet bowl, a hose for connecting the intake duct to a fan unit creating a vacuum through the intake duct and the hose so as to draw air from the toilet bowl region into the intake duct and then through the hose, a dispensing unit with a filter for treating air that receives the air drawn from the toilet bowl by the vacuum for creating a vacuum; and one or more switches for activating the apparatus. The toilet bowl ventilation apparatus can have a proximity sensor that can detect the presence of a person proximal to the toilet.

12 Claims, 8 Drawing Sheets

BOWL VENTILATION APPARATUS WITH PROXIMITY SENSOR

STATEMENT OF RELATED APPLICATIONS

This application is a continuation-in-part of U.S. patent application Ser. No. 10/093577, filed on Mar. 8, 2002, currently pending and allowed, and will issue as U.S. Pat. No. 6,550,072 on Apr. 22, 2003.

BACKGROUND OF THE INVENTION

1. Technical Field.

The present invention generally relates to a toilet bowl ventilation apparatus, and more particularly relates to a bowl ventilation apparatus that can be mounted on or incorporated within the structure of a toilet bowl for the removal of odors generally from a bathroom environment and specifically from the area immediately proximal to the toilet bowl, and which can be activated by a proximity sensor.

2. Prior Art.

Bathroom fans are a primary method of removing odors in a bathroom environment arising from toilet usage. Typically, these fans draw air nonspecifically from the bathroom environment and either recirculate the drawn air back into the bathroom, sometimes through a filter, or disperse the drawn air in alternative locations or environments. As these fans are usually in ceilings or high up on the wall, it can take a significant amount of time for odors to travel or be drawn from the toilet bowl region to the fan for removal. During this time, the user and subsequent users of the bathroom are exposed to these odors, which can be unpleasant.

Because bathroom fans can take a significant amount of time to replace, recirculate and/or cleanse the air in a bathroom environment, the user often is forced to open a window to augment odor removal. Although opening a window can help cleanse the air in a bathroom environment, the opening of a window exposes the bathroom to the external environment, subjecting the bathroom and the user to possible extremes in temperature and humidity, depending on the geographic location and the season. Further, additional resources such as electricity or natural gas may need to be expended to heat or cool the bathroom. Further complicating this situation, opening a window could result in dust and allergens entering into the bathroom environment, which can be harmful to some users and/or require the bathroom to be cleaned more often.

Often, bathroom fans are electrically connected to the light switch such that when the light switch is activated, the fan is activated. This can result in a waste of electricity for the times when the bathroom light is needed, but the fan is not needed. Alternatively, there may be a second switch for the fan alone. However, this requires the user to both remember that there is a second switch to activate the fan, and to actually activate the switch.

Thus, there is a need for a more efficient apparatus for removing odors from a bathroom environment. There also is a need for such an apparatus to be effective enough to eliminate the need to open a window to augment its odor removing function. There also is a need for an apparatus that can be placed proximal to the toilet bowl to help remove the odors proximal to the toilet bowl before they disperse into the general bathroom environment. Finally, there is a need for a device that addresses the above issues, and others, that is simple and automatic to operate without much if any user intervention. It is to these needs that the present invention is directed.

BRIEF SUMMARY OF THE INVENTION

Briefly, the present invention is bowl ventilation apparatus for removing odors or fumes proximal to and from within the toilet bowl. The present invention can be mounted proximal to or on the toilet bowl, or the toilet bowl can be structure to incorporate the present invention. In operation and use, the present invention provides an apparatus that helps remove odors close to their source and to keep such odors from spreading into the bathroom environment. The desired result is maintaining a bathroom that is more pleasant to the human olfactory sense. The preferred device has an automatic switch for activating the fan, preferably a proximity sensor or the equivalent.

More specifically, the present invention comprises an intake duct, an on/off switch, a powered fan, and a dispersing unit. The intake duct in one embodiment is structured to fit in the space between the toilet bowl rim and the toilet seat then the seat is in the closed position. In another embodiment, the intake duct is structurally formed into the toilet bowl rim when the toilet is manufactured. In another embodiment, the intake duct is structured to rest on the flat area generally found between the toilet seat and the water tank for home commodes or the water inlet pipe for institutional commodes.

The on/off switch can be manual or automatic or a combination of both. If a manual switch is used, it preferably is placed proximal to or on the intake duct for ease of use. If an automatic switch is used, it preferably is placed on the top of the intake duct or proximal and is activated either when the toilet seat is lowered and the user sits on the toilet seat or when the user is proximal enough to the toilet that the user activates the automatic switch. That is, activation can occur when the combined weight of the user and the toilet seat is on the switch, and when the user stands or other wise takes his or her weight off of the toilet seat, the weight of the toilet seat alone is not enough to activate the switch and deactivation occurs. Alternatively, the switch can be structured so that when only the toilet seat is lowered (that is, when only the weight of the toilet seat is on the switch), the switch is activated. Alternatively, a manual switch or a manual override switch and an automatic switch are used. The manual switch can be used to activate the automatic switch, such that when the manual switch is in the off position, the automatic switch will not operate, and when the manual switch is in the on position, the automatic switch will operate. That is, a manual override switch can be used to turn the device on and off irrespective of the operation of the automatic switch.

In a preferred embodiment, the on/off switch can be a proximity sensor. The proximity sensor can allow the activation of the ventilation system upon the detection of a person using or sitting on the toilet. More particularly, as the person approaches a preset distance from proximity sensor on the toilet, the proximity sensor will switch to the on position to activate the fan. To keep the fan activated, the person must remain at or within the preset distance from the proximity sensor. Otherwise, the proximity sensor will switch to the off position and deactivate the fan. Preferably, the proximity sensor activates the powered fan when the person gets close to or sits on the toilet. More specifically, the proximity sensor can be located on an inner edge of the intake duct or as a separate unit that communicates with the fan unit.

The powered fan and associated hardware, such as hoses, can be contained in a stand-alone unit placed on the bathroom floor, mounted on the bathroom wall, or for permanent installations contained in the bathroom wall. The intake duct can removably attached to the stand-alone unit for ease of cleaning and replacement. For such an alternative embodiment, the intake duct is connected to the stand-alone unit via a first connector on the intake duct hose that mates with a second connector on the stand-alone unit. The two connectors preferably have both a physical connection allowing odoriferous air to travel from the intake duct to the dispersing unit and an electrical connection allowing the activation switch or switches to activate the powered fan. The fan can be any of the known fans, such as for illustrative purposes bladed fans, squirrel cage fans, screw thread fans. The motor for the fan preferably is electric and is either plugged into a common electrical socket or is hard-wired into the electrical grid of the building. Alternatively, the fan motor can be battery operated or standard electric current reduced to the equivalency of a battery.

The dispersing unit and associated hardware, such as filters, fragrances, and exhaust means, preferably is contained in the same stand-alone unit as the fan or for permanent installations contained with the fan in the bathroom wall. Minimally, the dispersing unit comprises an exhaust duct for exhausting the drawn air back into the bathroom or to the exterior through the ceiling or wall. An odor eliminating filter is preferred if the drawn air is to be recirculated back into the bathroom, and various fragrance devices can be used to add a pleasant aroma to the recirculated air.

In operation and use, the bowl ventilation apparatus draws from within and proximal to the toilet bowl via a vacuum force generated by the fan through the intake duct, through a connecting hose, through and passed the powered fan, and finally through the dispersing unit. Alternatively, the dispersing unit can be located before the fan, that is, between the intake duct and the fan. The fan creates a vacuum drawing the air from the toilet area and then forces the air through the dispersing unit, if the dispersing unit is located behind the fan, or from the toilet area through the dispersing unit, if the dispersing unit is located in front of the fan. The optional filter can remove odors from the drawn air and/or the optional fragrance means can mask the drawn air with fragrance, and is useful for embodiments of the device that recirculate the air back into the bathroom. In alternative embodiments in which the dispersing unit distributes the drawn air to other locations or environments, a fragrance means is less useful.

These features and other features and advantages of the present invention will become more apparent to those of ordinary skill in the relevant art when the following detailed description of the preferred embodiments is read in conjunction with the appended drawings in which like reference numerals designate like components throughout the several views.

DETAILED DESCRIPTION OF THE PREFERRED EMBODIMENTS

Figure 1:
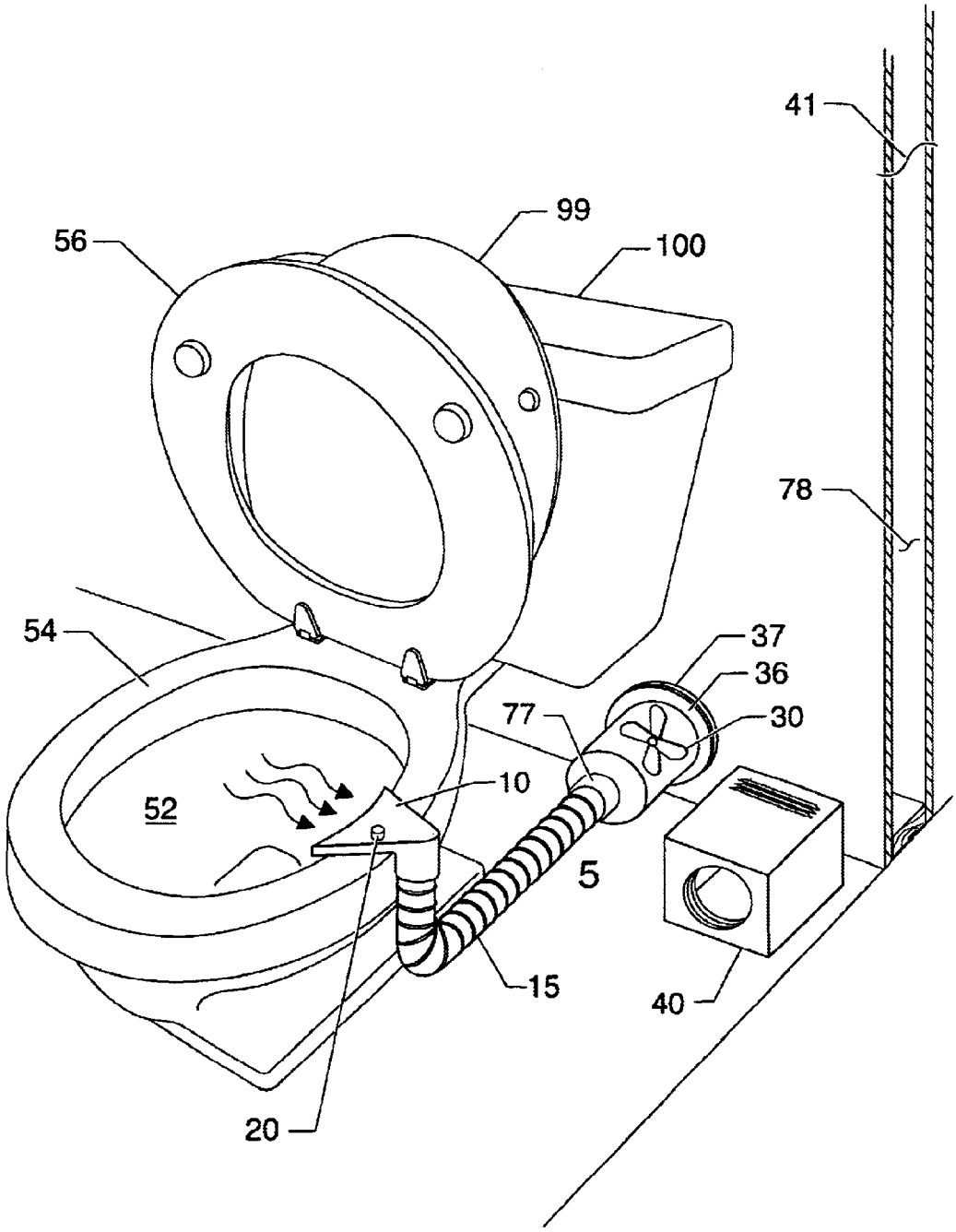
FIG. 1 is a perspective view of one embodiment of the present invention as placed proximally to a toilet bowl.

Referring to FIG. 1, a perspective view of a general embodiment of the bowl ventilation apparatus 5 mounted on a toilet 100 is shown. Ventilation apparatus 5 can be attached to common household toilets 100 having toilet bowl 52, toilet bowl rim 54, and toilet seat 56 pivotally attached to the rear portion of toilet bowl 52. Ventilation apparatus 5 is placed proximal to toilet bowl 52 and is intended to remove and/or cleanse the air in the region partially defined by toilet bowl 52. Intake duct 10 can fit between toilet bowl rim 54 and toilet seat 56 when toilet seat 56 is in the lowered position (as in the common toilet, where the toilet seat 56 is movable between a lowered position that is generally horizontal and proximal to the toilet rim 54 and maintained a spacing distance above the toilet rim 54 by feet or bumpers attached to the underside of the toilet seat 56 and a raised position that is generally vertical and normal to the toilet rim 54) without distorting or affecting the lowered position of toilet seat 56. More specifically, in this embodiment, intake duct 10 is structured to fit over and be supported by toilet bowl rim 54 and to be connected to powered fan unit 30 by hose 15. As disclosed in more detail below, intake duct 10 and hose 15 can be removably attached to powered fan unit 30 via first connector 77 and second connector 78.

Figure 2:
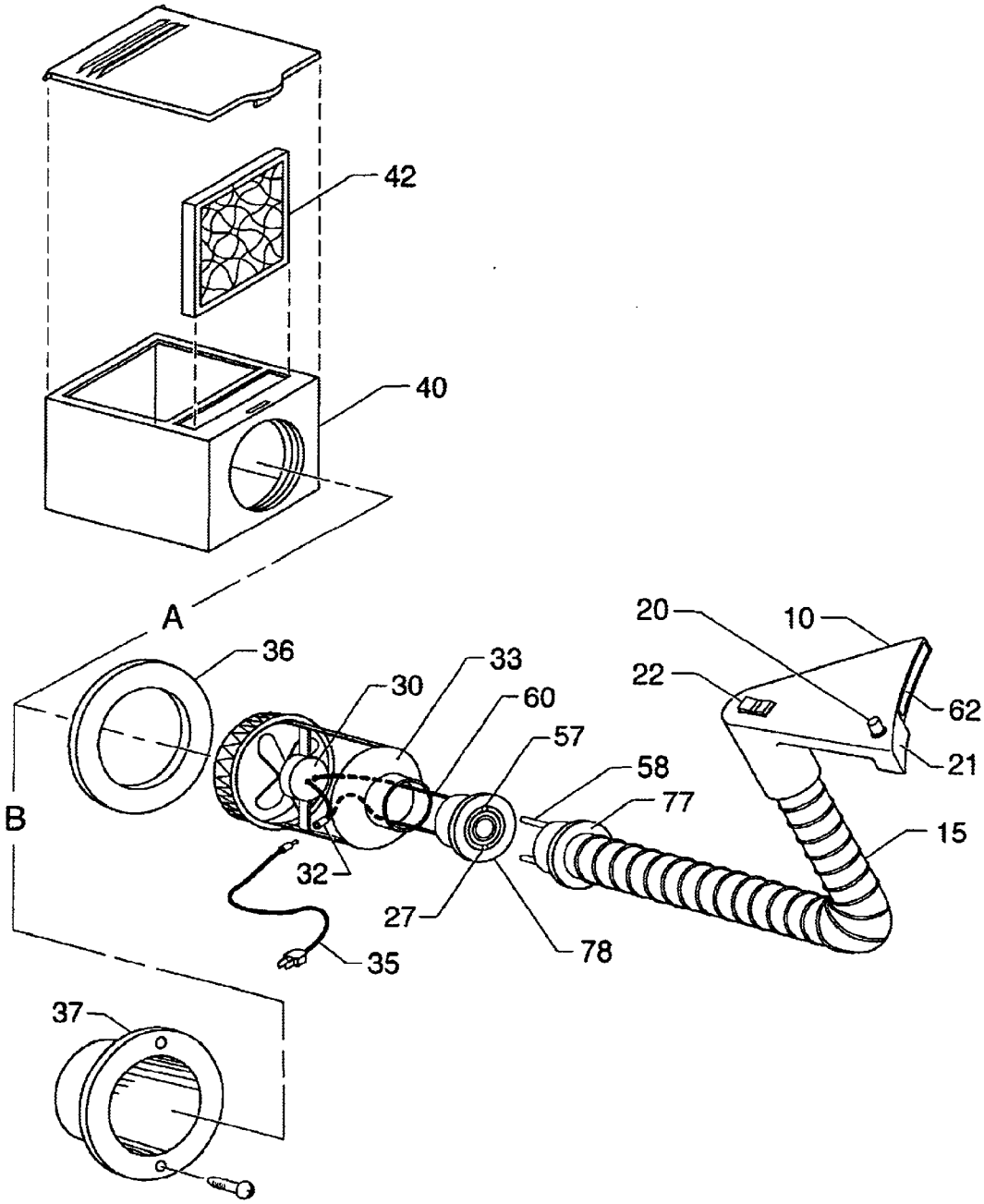
FIG. 2 is an exploded side view of one embodiment of the present invention showing its general components.

Referring to FIG. 2, one preferred embodiment of ventilation apparatus is shown in exploded detail. This embodiment is the portable stand-alone embodiment and is explained for illustrative purposes. However, the basic components for this embodiment are transferable to the other embodiments, including the wall-mounted and wall-contained embodiments. In general, ventilation apparatus 5 comprises intake duct 10, one or more switches 20, 22, powered fan unit 30, and dispensing unit 40. Intake duct 10 is connected to powered fan unit 30 by means of hose 15. Powered fan unit 30 is connected to dispensing unit 40 with intermediate connectors such flange 37 and seal 36, is contained within or a common part of dispensing unit 40, or is co-contained with dispensing unit 40 in a common box.

Two illustrative examples of dispensing unit 40 are shown in FIG. 2. In the first illustrative example, indicated by flow arrow A, powered fan unit 30 is connected to what is termed an internal dispensing unit 40. In this example, odoriferous air is recirculated back into the room after being treated with an odor removing filter 42 and/or fragrance introducing means. In the second illustrative example, indicated by flow arrow B, powered fan unit 30 can be connected directly to a vent pipe contained within a wall, which acts as what is termed an external dispensing unit 40. In this example, odoriferous air is exhausted out of the room and the building through the vent pipe, and a filter 42 and/or fragrance introducing means are not necessary. Flange 37 can be used to provide a connection to the vent pipe and to aesthetically cover any hole necessary in the wall. Both of these illustrative examples are disclosed in more detail below.

Powered fan unit 30 requires energy to perform its functions. Although the power source for powered fan unit 30 can be derived from numerous sources, preferably the power source is household AC current supplied by adapter plug 35 that fits into a standard electrical outlet, as this power source present in most households. Alternatively, powered fan unit 30 could be directly configured into the standard electric grid of the building or house. Alternatively, the power source could be derived from a battery or standard electric current reduced to the equivalency of a battery. Powered fan unit 30 is activated by one or more switches 20, 22 that are electrically connected to powered fan unit by wiring 60.

Figure 3:
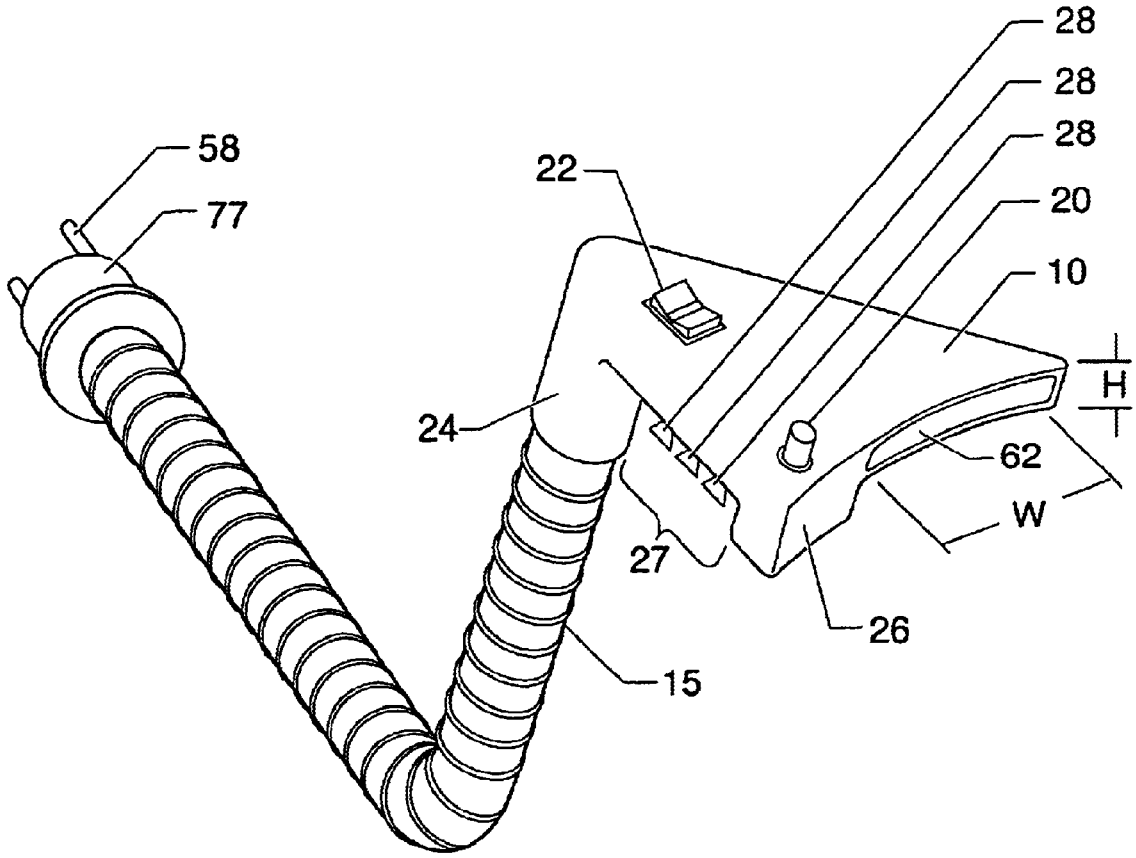
FIG. 3 is a perspective view of one embodiment of the intake duct component of the present invention.

Referring to FIG. 3, intake duct 10 is shown in more detail and comprises air intake 62, one or more switches 20, 22, hose connecting element 24, and attachment means 26. Intake duct 10 has a generally flat hollow box shape and has a height H that is thin enough to allow it to fit between toilet seat 56 in a lowered position and toilet rim 54. The width W of air intake 62 can be any desired value so long as it allows the drawing of a sufficient volume of air to allow the ventilation apparatus 5 to achieve its purpose. Preferably, intake duct 10 is of such a shape and structure that it can fit between toilet seat 56 and toilet rim 54 without causing toilet seat 56 to be raised or distorted by the placement of intake duct 10.

Although the actual shape of intake duct can is not overly important (many different shapes will achieve the desired purpose), a generally tapering shape has been found to be both functionally and aesthetically pleasing. For illustrative purposes, intake duct tapers from wide at air intake 62 end to narrow at hose connecting element 24 end. Functionally, this allows air intake 62 to be wider and have a greater intake cross-section nearest to the source of the odoriferous air, thus allowing a larger area for intake, while being narrower and less obtrusive outside of toilet 100 where it can be seen. Intake duct 10 defines a hollow airflow path from air intake 62 through the interior of intake duct 10 to hose connecting element 24, thus allowing the drawing of odoriferous air from toilet 100 through air intake 62, then through intake duct 10 and out through hose connecting element 24 into hose 15, and then on to dispensing unit 40. If connectors 27, 77 are used, the odoriferous air travels from hose 15 to powered fan unit 30 through cooperating openings in connectors 27, 77.

The combination of intake duct 10 and its component air intake 62, hose connecting element 24 and attachment means 26 can define a flattened or squared off upside down U shape, with hose connection element 24 and attachment means 26 serving and the uprights for the U. Groove 27 between hose connecting element 24 and attachment means 26 has approximately the same width as the toilet bowl rim 54 such that when intake duct is placed over toilet bowl rim 54, hose connecting element 24 fits down about the outside of toilet bowl rim 54 and attachment means 26 fit down about the inside of toilet bowl rim 54, with groove 27 cooperating with the top of toilet bowl rim 54. Generally, intake duct 10 is structure so that it remains on toilet bowl rim 54 even when toilet seat 56 is in the raised position. However, as added security, intake duct 10 may be further secured onto toilet bowl rim 54 by suction cups 28 or the like between groove 27 and toilet bowl rim 55.

Intake duct 10 has at least one switch 20, 22 for turning powered fan unit 30 on and off. In one embodiment, automatic switch 20, which is a depressible switch that is in the on position when depressed and is in the off position when extended or released, is used. This on/off configuration can allow ventilation apparatus 5 to be turned on by the combined applied pressure from the weight of toilet seat 56 and the weight of the toilet user on toilet seat 56. More specifically, toilet seat 56 is rotated downward from the raised position to the lowered position so that is rests on automatic switch 20; and once a user sits on toilet seat 56, automatic switch 20 is depressed fully which can activate fan unit 30 and thus ventilation system 5. In this embodiment, when the weight of the user is removed from toilet seat 56, automatic switch 20 is deactivated. This can be accomplished by many known means, the most typical of which is a spring-loaded automatic switch 20 whose spring has the strength or ability (force) to force the weight of toilet seat 56 upwards, thus deactivating automatic switch 20. Alternatively, automatic switch 20 can be activated by only from the pressure of the weight of toilet seat 56 on automatic switch 20. In these embodiments, as automatic switch 20 is on the top surface of intake duct 10, it preferably is a flush mount switch that is flush with the top surface of intake duct 10 when toilet seat 56 is in the lowermost position. Attachment means 26 can double as the switch housing for automatic switch 20. It is contemplated that automatic switch 20 can be located in other areas of intake duct 10 so long as automatic switch can be automatically activated by some means.

In another embodiment, manual switch 22, which can be any type of switch, is used. For example, manual switch 22 can be a depressible switch, a lever switch, a rotatable switch, a rocker switch or the like, as it preferably is located on the portion of intake duct 10 outside of the footprint of toilet seat 56. Manual switch 22 can allow a user to turn on ventilation apparatus 5 without having to sit on toilet seat 56 or place toilet seat 56 in a lowered position or combination thereof. Manual switch 22 can be helpful if the user desires ventilation apparatus 5 to remain on after the user gets off the toilet seat 56 or to be on before the user sits on the toilet seat 56. Further, as manual switch 22 can allow the user to keep the ventilation apparatus 5 in the off position, this allows a user to keep the unit off when the unit is not working properly and when the user does not desire to use the apparatus. It is understood that every embodiment of the present invention need not have manual switch 22.

In another embodiment, a manual switch 22 or a manual override switch 22 and an automatic switch 20 can be used. Manual switch 22 can be used to activate automatic switch 20, such that when manual switch 22 is in the off position, automatic switch 20 will not operate, and when manual switch 22 is in the on position, automatic switch 20 will operate. Manual override switch 22 can be used to turn ventilation apparatus 5 on and off irrespective of the operation of automatic switch 20.

Figure 4:
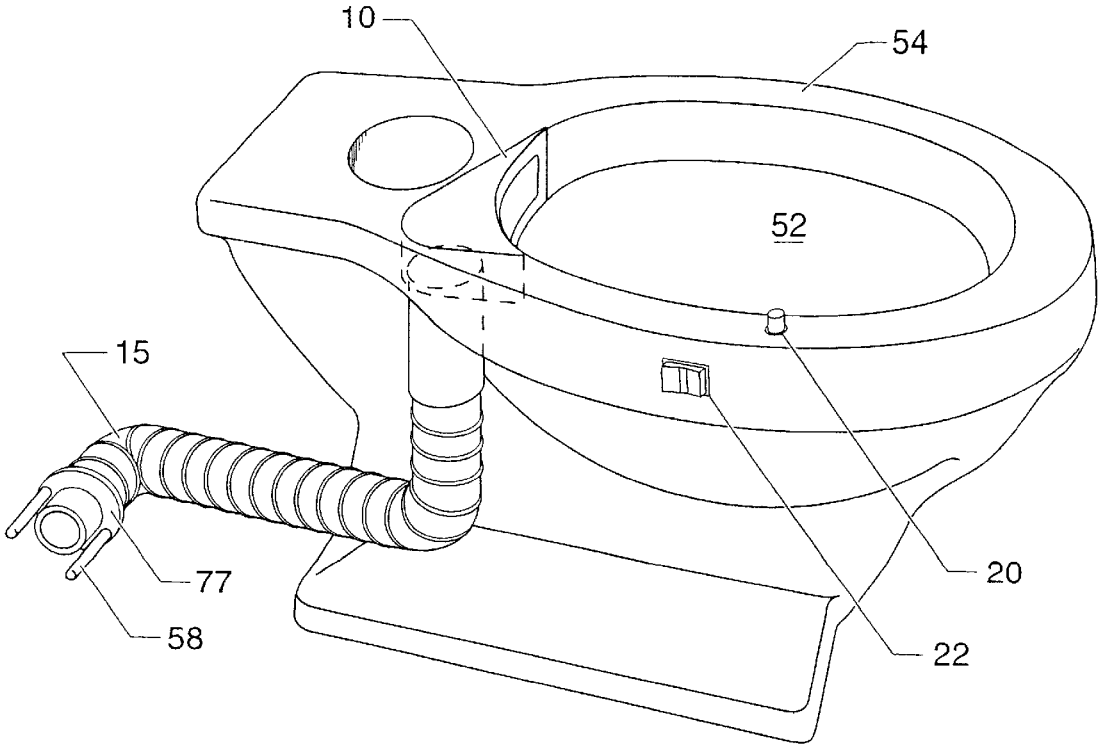
FIG. 4 is a ghost view of another embodiment of the present invention showing a permanent intake duct manufactured into the toilet bowl.

FIG. 4 is a ghost view of another embodiment of the present invention showing a permanent intake duct 10 manufactured into the toilet bowl rim 54, and is useful for original installations. Other embodiments, such as those discussed above and below, are useful as retrofit installations.

Figure 5:
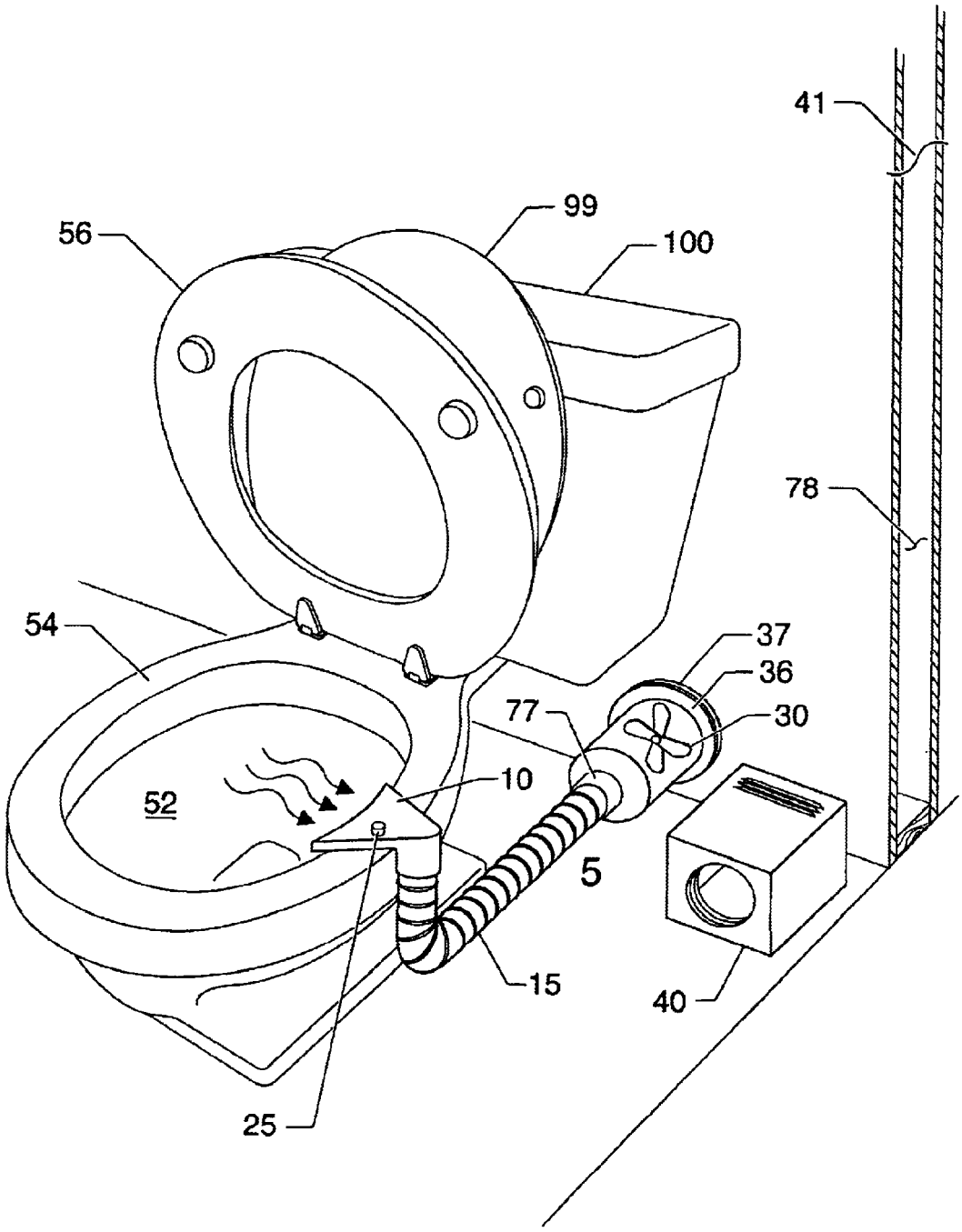
FIG. 5 is a perspective view of a preferred embodiment of the present invention as placed proximal to a toilet bowl and showing a proximity sensor.

Referring to FIG. 5, proximity sensor 25 can be used to activate ventilation fan 5 when a person is detected proximal to toilet 100. Generally, proximity sensor can be defined as a device that specifically deals with sensing the nearness or closeness of a person or object. Proximity sensor 25 can emit a light or radio frequency that, when interrupted at a certain distance, causes fan unit 30 to activate. Such a distance preferably is short, on the order of millimeters, to prevent the fan unit 30 from activating when someone just happens to be passing by. It is preferable that the interruption is continuous so as to keep the fan unit 30 activated. Otherwise, the moment the person moves out of the frequency range (that is, gets up from the toilet), the proximity sensor 25 will switch to the off position and thus deactivate fan unit 30. Proximity sensor 25 preferably would not activate fan unit 30 unless and until the user actually sits on the toilet and remains seated. Methods and devices that can be used to embody proximity sensor 25 are known to those of ordinary skill in the art.

As shown in FIG. 5, proximity sensor 25 is located on the upper side of intake duct 10 and is activated when toilet seat 56 is lowered over intake duct 10. However, in this embodiment, it is possible for fan unit 30 to be activated merely by lowering toilet seat 56, which may cause excess fan unit 30 operation, especially in houses having female inhabitants where common courtesy dictates that toilet seat 56 be kept in the lowered position at most times.

Figure 6:
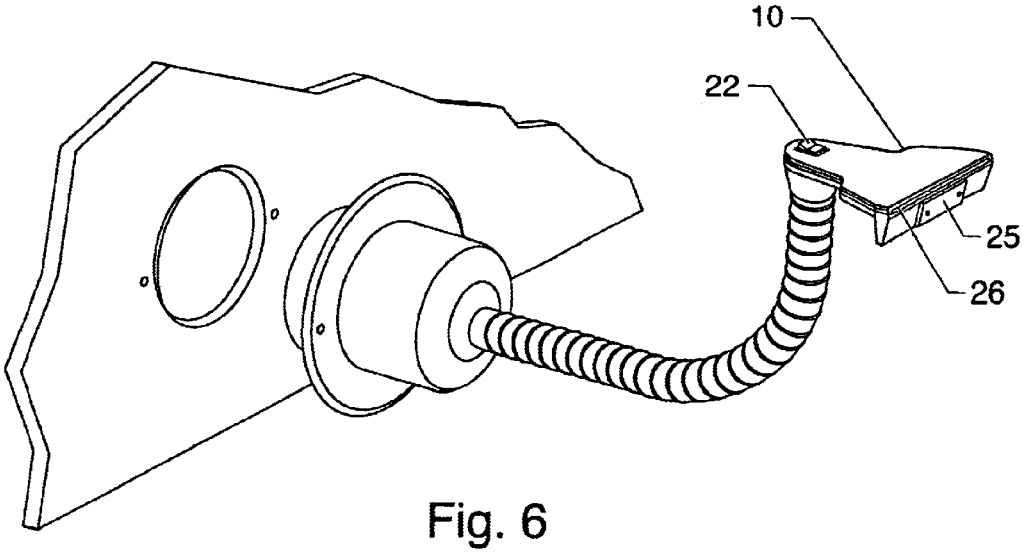
FIG. 6 is a perspective view of a second preferred embodiment of the present invention coupled to a wall exhaust unit and showing a proximity sensor and a manual override switch.
Figure 7:
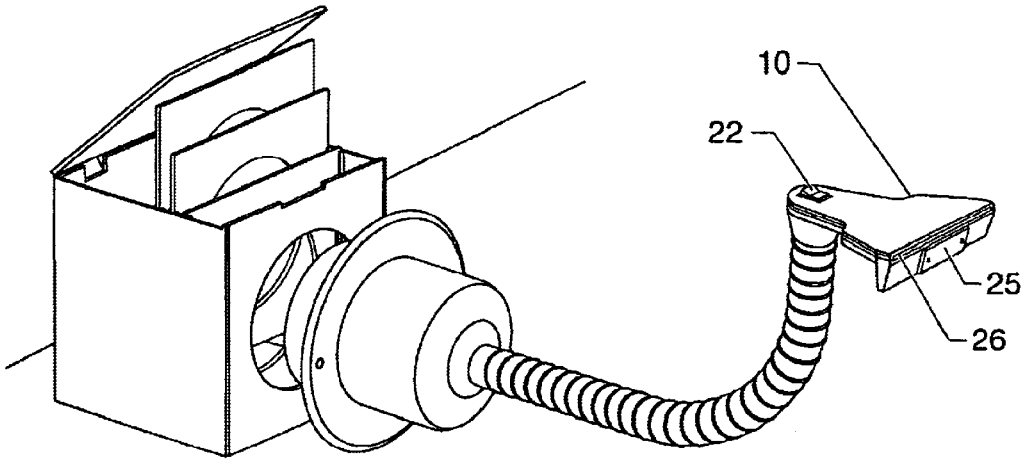
FIG. 7 is a perspective view of the second preferred embodiment of the present invention shown in FIG. 6 coupled to a portable exhaust unit.

As shown in FIGS. 6 and 7, proximity sensor 25 is located on the inner edge of intake duct 10. Lowering toilet seat 56 therefore would not affect or activate proximity sensor 25 in this embodiment. However, when toilet seat 56 is lowered and the user sits on toilet seat 56, the user's body would then be proximal to proximity sensor 25, thus activating proximity sensor 25. FIGS. 6 and 7 also show a manual override switch 22 and an alternate structure for air intake 62.

Figure 8:
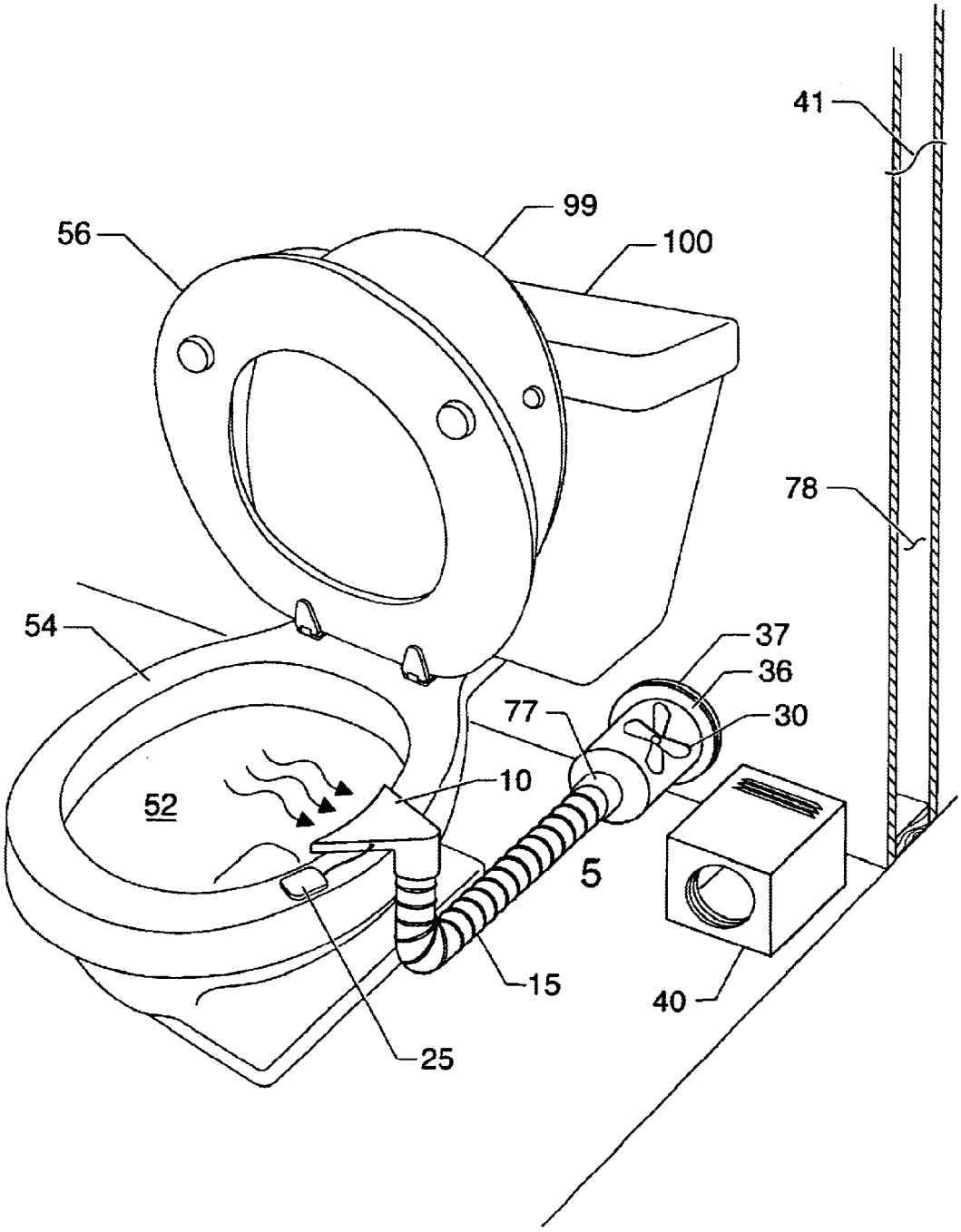
FIG. 8 is a perspective view of an alternate preferred embodiment of the present invention as placed proximal to a toilet bowl and showing a remote proximity sensor.

As shown in FIG. 8, proximity sensor 25 can be a remote structure from intake duct 10. In this embodiment, proximity sensor 25 can be placed at any location proximal to toilet 100 where a person or object would remain close to sensor 25. In FIG. 8, proximity sensor 25 is shown on toilet rim 54, but proximity sensor 25 can just as easily be located on toilet seat back 99 and activated when the user sits on toilet seat 56 and the user's back is proximal to toilet seat back 99, or on the top surface of toilet seat 56 itself and activated when the user sits on toilet seat 56. In this embodiment, as well as in the embodiments shown in FIGS. 6 and 7, to keep proximity sensor 25 activated, the person or user must come in close proximity to, and remain in close proximity to, proximity sensor 25 to keep proximity sensor activated.

One advantage of proximity sensor 25 is that it can conserve power. More particularly, proximity sensor 25 can help ensure that powered fan unit 30 is not powered when a person is not using toilet 100. Preferably, proximity sensor 25 will not activate ventilation fan unit 30 when a person walks by proximity sensor 25. More preferably, proximity sensor 25 is designed to be sensitive enough so that it only activates powered fan unit 30 when a person is using and remains seated on toilet 100. Not only does this invention save power, but also it promotes less wear and tear on the powered fan unit 30.

Placing switch 20, 22 in the on position turns on powered fan unit 30, which generates a vacuum that draws air through ventilation apparatus 5. More specifically, when powered fan unit 30 is activated, a vacuum is created within hose 15 and intake duct 10, thus drawing air proximal to air intake 62 into intake duct 10, through hose 15, through powered fan unit 30 and dispersing unit 40, and then exhausts the air.

Once odoriferous air arrives at dispensing unit 40, the odoriferous air either is exhausted (vented) outdoors or the odors are removed by filter 42 or masked by a fragrance means, or combination thereof. One example of filter 42 that can remove odors is activated carbon or charcoal. Activated carbon is common and a preferred filter 42 because it can remove up to 60% of its weight in odors and can capture ammonias, formaldehydes, and sulfides. However, filter 42 can include zeolites and other filtering agents as will be obvious to those with skill in the art. Further, filter 42 can include fragrances, which can mask odors and can have the added benefit of adding a pleasant smell to the dispersed environment.

Once the odoriferous air has been filtered, the filtered air exits the dispensing unit 40. As the air has been filtered, it often is acceptable to exhaust the air back into the bathroom environment. Further, as dispensing unit 40 can have a fragrance agent, the flow of air back into the bathroom will add the fragrance to the bathroom environment, which adds a pleasant smell to the bathroom. Alternatively, the filtering unit can dispense the air in an alternate location or outside. Common exhaust hardware can be used for such an embodiment.

It is contemplated that intake duct 10 and its hose 15 assembly can be removably attached to powered fan unit 30 by using a first connecter 77 with electrical plug 58 and a second connector, such as receptacle 78. In this optional embodiment, intake duct 10 and hose 15 become a replaceable part, should intake duct 10, hose 15, and/or switch 20, 22 become non-functional and/or too soiled to be cleaned. More specifically, switch 20, 22 wiring can electrically connect switch 20, 22 to electrical plug 58. Electrical plug 58 is inserted into electrical sockets 57 on receptacle 78. Electrical sockets 57 are electrically connected to powered fan unit 30 such that when electrical plug 58 is inserted into receptacle 78, an electrical connection is made between switch 20, 22 and powered fan unit 30. The combination of electrical plug 58 and receptacle 78 allow intake duct 10 and hose 15 to be connected and disconnected from powered fan unit 30 for ease of maintenance, replacement or repair. Other means for providing a reversible connection between hose 15 and powered fan unit 30 are understood by those of ordinary skill in the art.

In operation and use, odoriferous air is drawn away from a region generally defined by toilet bowl 52 once powered fan unit 30 has been activated. As disclosed previously, activation is either by the user manually activating manual switch 22, by toilet seat 56 depressing automatic switch 20 by the weight of the user or by activating proximity sensor 25. When activated, powered fan unit 30 creates a vacuum that draws air from the region generally defined by toilet bowl 52 into intake duct 10 through air intake 62. From intake duct 10, the air is drawn through hose 15 through hose connecting element 24, through and past powered fan unit 30, and into dispensing unit 40. The air is processed in dispensing unit 40 by exhausting the air outdoors or by filtering the air and/or adding fragrance to the air and recirculating the air back into the bathroom environment. Powered fan unit 30 then can be deactivated by either placing manual switch 22 in the off position, by pivoting toilet seat 56 upwards which will place automatic switch 20 in the off position, by removing the user's weight from toilet seat 56 if an automatic switch 20 with sufficient spring force is used, or by the user moving away from proximity sensor 25.

It should be noted that the air can be treated by any combination of exhausting the air, filtering the air and/or adding fragrance to the air, or the like, as desired by the installer. Further, as many exhaust vent pipes are present in houses and buildings, ventilation apparatus 5 can be connected to such an exhaust vent pipe without undue effort. One advantage of connecting ventilation apparatus 5 to exhaust vent pipe is that filtering agents may not be needed as exhaust pipe removes the air from the house or building.

In another embodiment, as shown in FIG. 4, intake duct 10 can be built partially or entirely into toilet bowl 52. One advantage of building intake duct 10 partially or entirely into toilet bowl 60 is that this construction allows for ventilation system 5 to have a bigger intake duct 10 as the thickness of intake duct 10 is not limited to the distance between toilet seat 56 and toilet bowl rim 54. A bigger intake duct 10 may allow ventilation system 5 to filter more air in a quicker fashion. Hose 15 then would be connected to hose connecting element 24 incorporated onto toilet 100. Powered fan unit 30 and dispensing unit 40 preferably still would be located external to toilet.

In another embodiment for use with an exhaust vent dispensing unit 40 is an exhaust vent, powered fan unit 30 can be behind a wall and not be seen from the bathroom view. An access door may be necessary to access powered fan unit 30 for replacement or repair.

Figure 9:
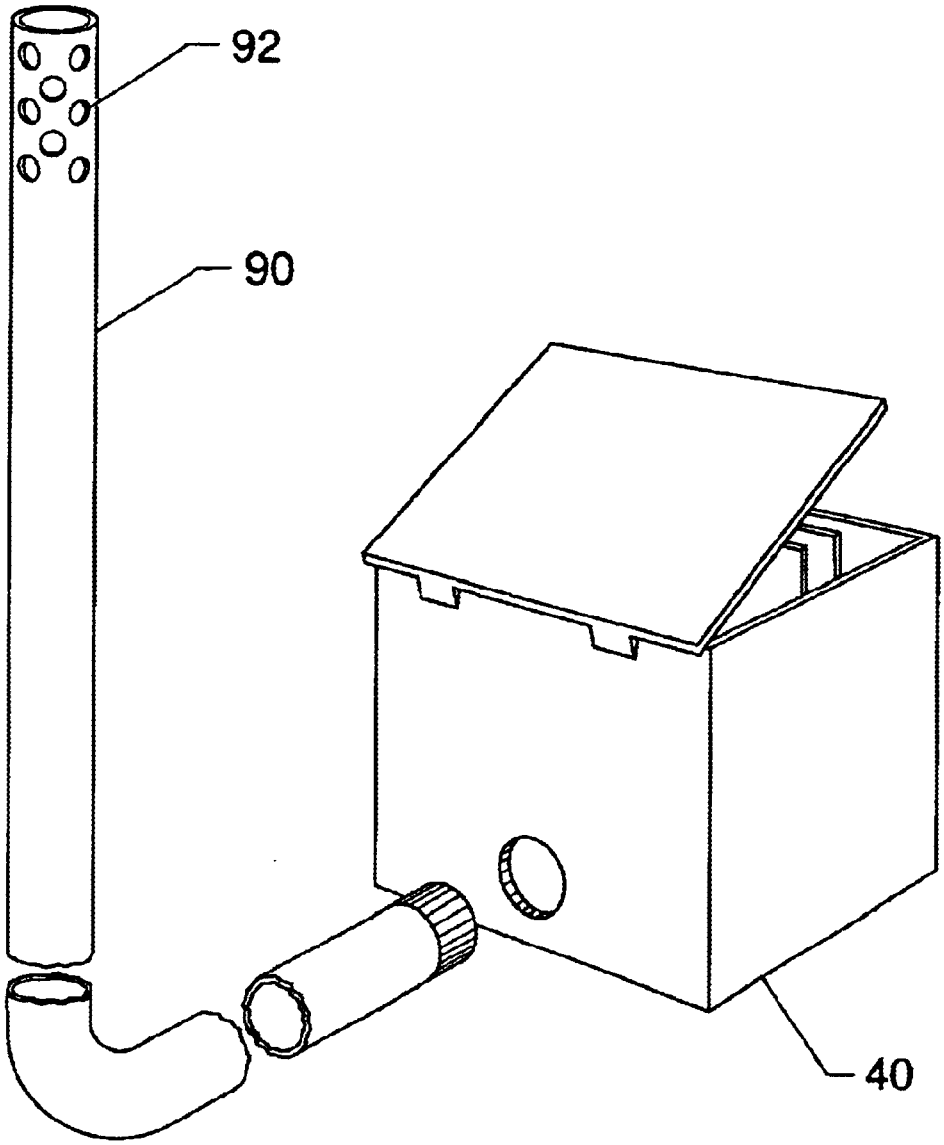
FIG. 9 is a perspective view of an alternate embodiment of a portable exhaust unit for use with the present invention showing a snorkel exhaust pipe.

In another embodiment shown in FIG. 9, the treated air can be exhausted back into the room through a snorkel-like attachment 80. This embodiment would exhaust the treated air proximal to the ceiling of the room where it then could be removed from the room by an existing ceiling fan. In any event, by dispersing the treated air closer to the ceiling, the treated air is dispersed as far from the user as possible within the confines of the room. Dispersal holes 92 can allow for a 360 degree dispersal of the treated air.

The above detailed description of the preferred embodiments, examples, and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. A toilet bowl ventilation apparatus for treating air from a toilet bowl region comprising:

a. intake duct proximal to the toilet bowl;

b. hose for connecting the intake duct to a means for creating a vacuum, wherein the means for creating a vacuum creates a vacuum through the intake duct and the hose so as to draw air from the toilet bowl region into the intake duct and then through the hose, wherein the intake duct, the hose, and the means for creating a vacuum are a portable single unit;

c. means for treating air that receives the air drawn from the toilet bowl by the means for creating a vacuum;

d. proximity sensor for activating the apparatus; and e. means for connecting the means for creating a vacuum to an exterior vent or to the means for treating air, wherein the intake duct is removably connected to a toilet rim about a top edge of the toilet bowl; the intake duct is mounted on the toilet bowl by placing a groove located on a bottom side of the intake duct over the toilet rim; and a user can control the destination of the air drawn from the toilet bowl region by connecting the means for creating a vacuum to an exterior vent for venting the air to the exterior or by connecting the means for creating a vacuum to the means for treating air for recirculating the treated air to a room in which the toilet bowl is found.

2. The bowl ventilation apparatus as claimed in claim 1, further comprising a toilet seat movable between a lowered position that is generally horizontal and proximal to the toilet rim and maintained a spacing distance above the toilet rim and a raised position that is generally vertical and normal to the toilet rim, wherein the intake duct has a generally flat structure comprising a top side and the bottom side, a hollow flow path between the top side and the bottom side, and a thickness from the top side to the bottom side no greater than the spacing distance.

3. The toilet bowl ventilation apparatus as claimed in claim 1, wherein the means for treating air comprises a filter for removing odors contained in the air.

4. The toilet bowl ventilation apparatus as claimed in claim 1, wherein the single unit is attached to a wall-mounted vent for venting the air to the exterior.

5. The toilet bowl ventilation apparatus as claimed in claim 1, wherein the proximity sensor comprises an infrared frequency that detects the presence of a person substantially close to or on the toilet.

6. The toilet bowl ventilation apparatus as claimed in claim 1, wherein the proximity sensor is only activates the ventilation apparatus when a person is on the toilet.

7. A toilet bowl ventilation apparatus for treating odoriferous air from a space within a towel bowl that has a toilet rim about an upper edge of the toilet bowl, the apparatus comprising:

a. an intake duct proximal to the toilet bowl;

b. a powered fan unit for creating a vacuum through an air intake at a first end of the intake duct;

c. a hose for connecting a second end of the intake duct to the powered fan unit, wherein the intake duct, the hose, and the powered fan unit are a portable single unit;

d. a means for treating the odoriferous air by passing the odoriferous air through a filter comprising a fragrance;

e. a means for connecting the powered fan unit to an exterior vent or to the means for treating the odoriferous air;

f. a means for detecting a person substantially proximal to the toilet and for activating the apparatus; and g. proximity sensor for activating the apparatus, wherein the intake duct comprises a bottom side comprising a groove for cooperating with the toilet rim to maintain the intake duct on the toilet rim; the vacuum created by the powered fan unit draws the odoriferous air from the toilet bowl into the intake duct, through the hose, and to the means for treating the odoriferous air; and the intake duct is positioned between a toilet seat and the toilet rim, whereby a user can control the destination of the treated air by connecting the powered fan unit to the exterior vent thus venting the air drawn from the toilet bowl to the exterior or by connecting the means for creating a vacuum to the means for treating air and recirculating the treated air back into the region.

8. The bowl ventilation apparatus as claimed in claim 7, wherein the proximity sensor is a means for detecting a person substantially proximal to the toilet and for activating the apparatus.

9. The toilet bowl ventilation apparatus as claimed in claim 8, wherein the proximity sensor is only activates the ventilation apparatus when a person is on the toilet.

10. A toilet bowl ventilation apparatus for treating air from a region within a toilet, the toilet comprising a toilet bowl, a toilet rim about an upper edge of the toilet, and a toilet seat movable between a lowered position that is generally horizontal and proximal to the toilet rim and maintained a spacing distance above the toilet rim and a raised position that is generally vertical and normal to the toilet rim, the apparatus comprising:

a. an intake duct proximal to the toilet bowl and having a generally flat structure comprising a top side and a bottom side, a hollow flow path between the top side and the bottom side, and a thickness from the top side to the bottom side no greater than the spacing distance, wherein the bottom side comprises a groove for cooperating with the toilet rim to maintain the intake duct on the toilet rim and the intake duct is mounted on the toilet bowl by placing the groove over the toilet rim;

b. a hose for connecting the intake duct to a means for creating a vacuum, wherein the means for creating a vacuum creates a vacuum through the intake duct and the hose so as to draw air from the toilet bowl region into the intake duct and then through the hose wherein the duct, the hose, and the means for creating a vacuum are a portable single unit;

c. means for treating air that receives the air drawn from the toilet bowl by the means for creating a vacuum, wherein the means for treating the air filters odors from the air and adds fragrance to the air;

e. means for activating the apparatus that is activated by a proximity sensor;

f. a switch for manually overriding the means for activating the apparatus; and g. means for connecting the means for creating a vacuum to an exterior vent or to a means for treating air, whereby a user can control the destination of the treated air by connecting the means for creating a vacuum to an exterior vent thus venting the air drawn from the toilet bowl to the exterior or by connecting the means for creating a vacuum to the means for treating air and recirculating the treated air back into the region.

11. The bowl ventilation apparatus as claimed in claim 10, wherein the proximity sensor is a means for detecting a person substantially proximal to the toilet and for activating the apparatus.

12. The toilet bowl ventilation apparatus as claimed in claim 11, wherein the proximity sensor is only activates the ventilation apparatus when a person is on the toilet.

* * * * *